United States Patent [19]

Jachowski

[11] 4,249,148

[45] Feb. 3, 1981

[54] CUBICAL MULTIPLE CAVITY FILTER AND COMBINER

[75] Inventor: Ronald E. Jachowski, Paradise Valley, Ariz.

[73] Assignee: Decibel Products, Inc., Dallas, Tex.

[21] Appl. No.: 21,542

[22] Filed: Mar. 19, 1979

[51] Int. Cl.[3] ..... H01P 1/207

[52] U.S. Cl. ..... 333/208; 333/209; 333/227; 333/230

[58] Field of Search ..... 333/208, 209, 227, 229–232

[56] References Cited

U.S. PATENT DOCUMENTS 2,357,314 9/1944 Carter ..... 333/208

*Primary Examiner*—Eugene R. LaRoche

*Attorney, Agent, or Firm*—Cahill, Sutton & Thomas

[57] ABSTRACT

A cubical device includes six square sides connected to form a cube. Each side has an electrically conductive inner surface electrically connected to the other inner surfaces. A plurality of electric field probes attached to coaxial connectors centrally mounted on respectively perpendicular sides of the cube extend into the volume bounded by the cube. In one embodiment of the invention, three opposing pairs of electric field probes extend into the volume from opposite sides of the cube. The electrical cube then functions as three independent bandpass filters, each having a "Q" determined by the volume. In another embodiment of the invention, an output probe extends into the cavity at a predetermined angle and senses the standing wave patterns produced in response to the electric field probes, whereby the cubical apparatus functions as a bidirectional combiner for up to three channels. In a further embodiment of the invention, one or more grounded conductive loops extend into the volume to produce interference between standing wave patterns therein, effecting internal coupling which causes the cubical device to function as one of a variety of composite filters, such as a double tuned filter or a composite bandpass filter with one or more notches in its output characteristic.

25 Claims, 10 Drawing Figures

CUBICAL MULTIPLE CAVITY FILTER AND COMBINER

BACKGROUND OF THE INVENTION

1. Field of the Invention

The invention relates to microwave cavities utilized as filters, duplexers, and transmitter combiners, and more particularly, to devices which contain more than one standing wave pattern in a single volume.

2. Description of the Prior Art

Tuned cavities of various types have been used in various high frequency communications applications for many years. Two common types of cavities include coaxial cavities and square prism filters. Such cavities are commonly connected in well known configurations to provide bandpass filters, notch filters, composite bandpass/notch reject filters and combiners (including duplexers and transmitter-combiners). Combiners as defined herein, are bidirectional devices which allow two or more bidirectional radio systems to operate on a single transmission line and antenna. Tuned filters, composite filters, and combiners of the prior art must be constructed by connecting the above described types of tuned cavities together by means of transmission lines and junction devices. Unfortunately, for commonly used communications bands such as the 450–470 and 850–870 megahertz bands which are widely used for mobile communications systems, prior tuned cavity systems are unduly large and bulky. For example, high Q coaxial tuned cavities for the 450–470 bands is approximately three feet in height and approximately one foot in diameter. A rather large number of such bulky tuned cavities may be required for a particular radio system installation. Consequently, composite tuned filter and combiner systems for the above bands are very bulky and are also unduly expensive. Obviously, the problem is more acute for the 150 megahertz band.

Due to the popularity of mobile radio communications systems in major metropolitan areas, and also due to the bulkiness of the tuned cavity filter and combiner systems of the prior art, there is an acute scarcity of optimum antenna locations. Such antenna locations are typically situated at the tops of the few tallest buildings in a particular metropolitan area. Consequently, antenna space and space for storing associated tuned filter and combiner systems is at a premium, and rental for such space is very costly.

Accordingly, it is a primary object of the invention to provide a tuned cavity system which is substantially less expensive to build than tuned cavity systems of the prior art.

Another object of the invention is to provide a tuned cavity system capable of performing substantially the same function as prior art tuned cavity systems, which tuned cavity system occupies substantially less space than tuned cavity systems of the prior art.

Still another object of the invention is to provide a tuned cavity device which can be used as a building block for tuned cavity systems which are less expensive and bulky than tuned cavity systems of the prior art.

A major reason that tuned cavity systems of the prior art are so bulky is that a large number of separate tuned cavities are required to construct composite tuned filter and/or combiner systems, since the tuned cavities of the prior art each contain only one resonant standing wave pattern.

Accordingly, an object of the invention is to provide a tuned cavity device which is capable of containing more than one resonant standing wave pattern in a single volume.

When the above mentioned tuned cavity filter and/or combiner systems are constructed by connecting individual coaxial cavities or square prism filters together by means of cables, it is necessary that cable lengths be very precisely cut (i.e., to exactly half wave lengths) in order to construct a combiner. This requirement adds additional costs, and requires services of skilled technicians when additional channels are added to a pre-existing system.

Accordingly, yet another object of the invention is to provide a combiner system without the requirement that separate tuned cavities be connected together by means of precisely cut cables.

Yet still another object of the invention is to provide a tuned cavity system which overcomes the above mentioned shortcomings of prior art tuned cavity systems and components, and which has performance characteristics including acceptably high Q, low insertion loss, and low channel separation such that the tuned cavity system can be used in place of prior tuned cavity systems in state of the art radio communication systems.

A novelty search directed to the present invention uncovered the following U.S. Pat. Nos.: 2,044,413, 2,250,308, 2,400,777, 2,477,581, 2,530,603, 2,894,225, 2,943,284, 3,247,474, 3,529,235, 3,735,289, 3,790,905, 3,851,131, 3,876,963, 3,882,434, 4,028,652, 4,034,319, 4,060,778, 4,060,779.

The state of the art is further indicated by the publications "Cavities and/or Ferrites: Their Practical Use in Combiners and Multicouplers" (*Technical Bulletin No.* 10419); "Application and Theory of Cavities in Duplexers" (*Technical Bulletin No.* 91001); and, "Low Loss Closely Spaced Multi-Transmitter Combiners", all by Ray Trott and all published by Decibel Products, Inc., of Dallas, Tex.

SUMMARY OF THE INVENTION

Briefly described, and in accordance with one embodiment thereof, the invention provides a cubical apparatus for establishing and containing from one to three standing wave patterns in response to excitation by a plurality of electric field probes extending into the volume bounded by the cubical apparatus from a plurality of mutually perpendicular sides of the cubical apparatus. The cubical apparatus includes six sides having electrically conductive inner surfaces, each electrically connected to the inner surfaces of the adjacent sides. The respective electrical and magnetic fields associated with the three standing wave patterns are everywhere mutually orthogonal. Consequently, the three standing wave patterns resonate essentially independently of each other within the single volume.

In one embodiment of the invention, three electric field input probes extend into the volume from central locations of first, second, and third mutually perpendicular sides of the cubical apparatus. The electric field input probes are connected to center conductors of coaxial cable connectors mounted on the respective first, second, and third sides. Fourth, fifth, and sixth electric field output probes extend into the volume from central locations of the fourth, fifth and sixth sides which are opposed, respectively, to the first, second, and third sides. In this embodiment of the invention, the cubical apparatus functions as three independent tuned bandpass filters. Tuning slugs adjacent the fourth, fifth, and sixth coaxial connectors (connected, respectively, to the fourth, fifth, and sixth electric field probes) are manually adjustable to extend into the volume, permitting independent tuning of the resonant frequencies of the three standing wave patterns. A plurality of temperature compensation tuning slugs controllably extend into the volume from positions adjacent the fourth, fifth and sixth coaxial connectors. The distance to which the temperature compensation tuning slugs extend is a function of the temperature of the cubical apparatus. As temperature increases, the tuning slugs extend less into the volume to compensate for expansion of the sides of the cube caused by the temperature increase so that the resonant frequencies of the standing wave patterns in the volume are independent of temperature of the cubical apparatus.

In another embodiment of the invention, electric field input probes extend into the volume from two mutually perpendicular sides. Opposed electric field output probes extend into the volume from corresponding opposite sides. A grounded loop extends into the volume from the center of the top side of the cubical apparatus from a center conductor of a coaxial cable mounted at the center of the top side. The opposite end of the loop is electrically connected to the conductive inner surface of the top of the cube at a point on a diagonal of the top side. In this embodiment of the invention, the cubical apparatus functions as a bi-directional two channel combiner.

In another embodiment of the invention, three electric field input probes extend into the volume from three mutually perpendicular sides of the cubical apparatus. An output probe extends from the common corner of the three sides diagonally along the top side, and is inclined into the volume at an angle of several degrees with respect to the top side. This embodiment of the cubical apparatus functions as a bidirectional three channel combiner.

In a further embodiment of the invention, an electric field probe extends into the volume from a first side, and an electric field output probe extends into the volume from a second side perpendicular to the first side. A grounded loop is attached to the conductive inner surfaces of a third side mutually perpendicular to the first and second sides to produce interference in the standing wave patterns in the volume. The cubical apparatus then functions as a double tuned filter.

The cubical apparatus of the invention can be configured to provide a number of other useful devices including (1) a bandpass filter having one input, one output, and tuned to have characteristics of either a single, double or triple tuned filter, (2) a bandpass filter having one input, one output, and tuned to have a single tuned response with one double reject notch or two single reject notches either above or below the bandpass frequency or two single reject notches, one above, and one below the bandpass frequency, (3) a two channel combiner with two inputs and one output with a single reject notch tuned above, below, or between the two input frequencies, and (4) a band reject filter.

DESCRIPTION OF THE INVENTION

Figure 1:
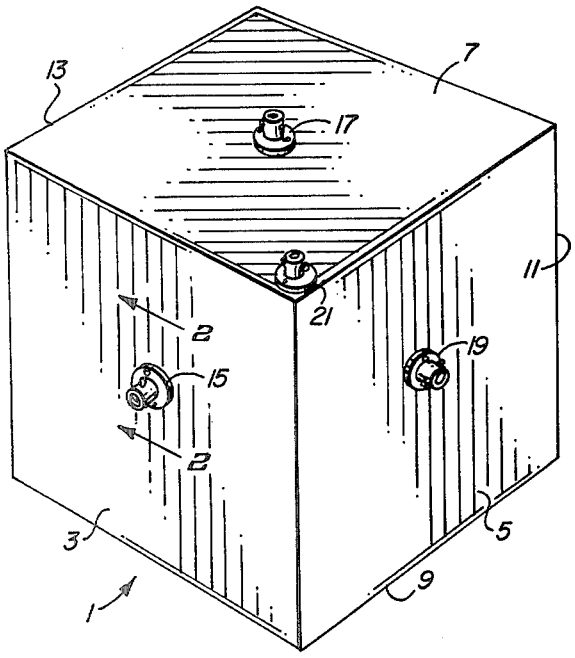
FIG. 1 is a perspective view of the tuned cavity device of the present invention.

Referring now to FIG. 1, cubical apparatus or device 1 includes six square sides connected together to form a cube. The sides include vertical sides 3, 5, 11 and 13, top side 7, and bottom side 9, hereinafter all referred to simply as "sides". All six sides have conductive inner surfaces which are electrically connected together. The sides can be constructed of copper sheet material or of other conductive or non-conductive materials lined with electrically conductive material. As will become apparent subsequently, the basic cubical apparatus can be provided with various arrangements of electric field input probes, electric field output probes, and conductive loops extending into the volume bounded by the six sides from various locations and at various angles to provide a large variety of tuned cavity devices.

Figure 2:
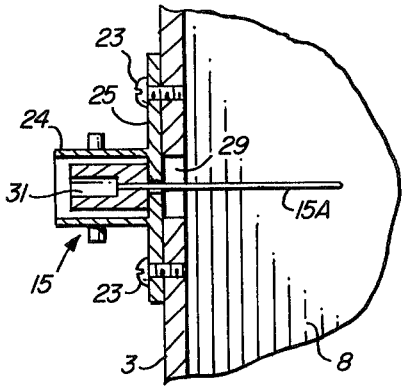
FIG. 2 is a sectional view along section lines 2—2 of FIG. 1.
Figure 3:
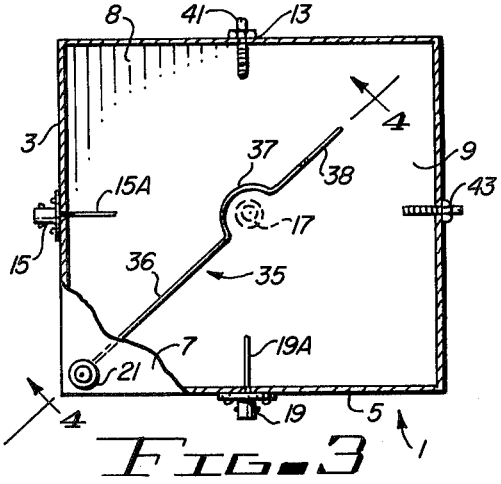
FIG. 3 is a partial cut away top view of the device of FIG. 1.
Figure 4:
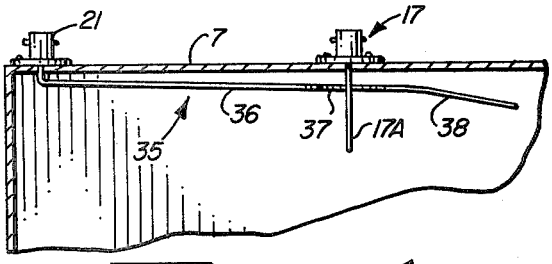
FIG. 4 is a partial sectional view taken along section lines 4—4 of FIG. 3.

The embodiment of the invention shown in FIGS. 1–6 is a three channel combiner. Its structure will be described in detail with respect to FIGS. 1–6. A plurality of ordinary coaxial conductors 15, 17 and 19 are mounted precisely in the center of first, second and third mutually perpendicular sides 3, 7 and 5, respectively. The center conductor of each coaxial connector is connected to a straight electric field probe (hereinafter referred to as "E field probe") which extends into volume 8 bounded by cubical apparatus 1. More specifically, E field input probes 15A and 19A extend through holes in conductive sides 3 and 5 from the center conductors of coaxial conductors 15 and 9, respectively, as shown in FIG. 3. E field input probe 17A extends from the center conductor of coaxial connector 17 through a hole in top side 7, as shown in FIG. 4. The outer conductors of the coaxial connectors are electrically connected to the conductive sides on which they are mounted.

FIG. 2 illustrates in detail the structure of coaxial connector 15 of FIG. 1. Referring now to FIG. 2, coaxial connector 15 includes an outer conductor 24 having a flange 25. Flange 25 is bolted to copper side 3 by means of bolts 23. A hole 29 in side 3 permits E field input probe 15A to extend from center conductor 31 of coaxial connector 24 into volume 8 without touching conductive side 3.

In accordance with the present invention, signals from three different microwave communication channels can be applied to E field probes 15A, 19A and 17A. The three signals can have different frequencies, within, for example, the 450–470 megahertz band. The signals on the three E field input probes produce three substantially resonant standing wave patterns which substantially independently coexist in volume 8. Therefore, volume 8 hereinafter is considered to include or contain three separate tuned "cavities". The standing waves of the three patterns propagate in three mutually perpendicular directions. Consequently, the electric field components associated with each standing wave pattern are mutually perpendicular to the electric field components of the other two standing wave patterns. Similarly, the magnetic field components of each of the standing wave patterns are mutually perpendicular to the magnetic fields of the other two standing wave patterns. In accordance with the present invention, it has been discovered that the three standing wave patterns resonate with virtually no mutual interference if the six sides are precisely square.

For the above mentioned 450 megahertz band, each edge of cubical apparatus 1 is approximately 18 inches in length. It has been found that an optimum probe length for E field probes 15A, 19A, 17A, etc., is approximately 2.5 inches. The diameter used is 15 mils. The probes used are constructed of copper wire and extend into volume 8 perpendicularly to the respective sides from which they extend.

Figure 6:
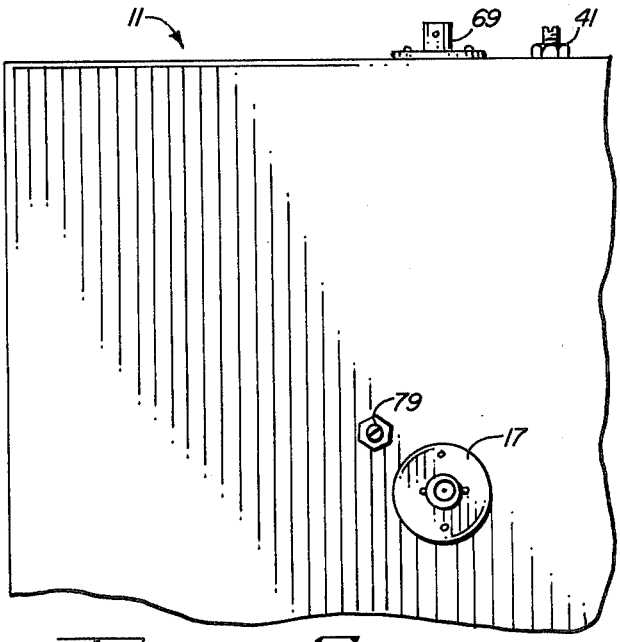
FIG. 6 is a partial top view of the embodiment of the invention shown in FIG. 10.

For each embodiment of the invention described herein, the resonant frequency of each of the three above mentioned tuned cavities which coexist within volume 8 can be decreased by means of tuning slugs which are extended into volume 8 from one of the pair of parallel sides between which a particular standing wave pattern propagates. The tuning slugs are preferably located as centrally as possible with respect to the sides from which they extend. However, it is much more important that the E field input probes be precisely centrally located on the sides. When both an E field input probe and a tuning slug are required on the same side, the scheme shown in FIG. 6 is used, as explained below.

Figure 5:
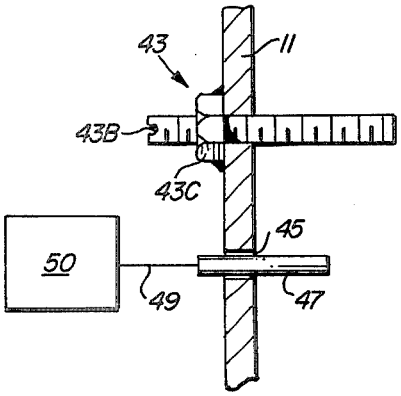
FIG. 5 is a section view illustrating a manually controlled tuning slug and a temperature responsive tuning slug which may be utilized in the device of FIG. 1.

FIG. 3 illustrates two tuning slug assemblies 41 extending into volume 8 from sides 13 and 5 of cubical apparatus 1. FIG. 5 illustrates one embodiment of tuning slug assembly 43, which contains a threaded conductive "nut" attached to conductive side 11. A threaded tuning slug 43A having a screwdriver slot 43B on the outer end thereof extends into volume 8 a distance manually adjustable by means of a screwdriver. The presence of conductive slug 43A in volume 8 adds capacitance which reduces the resonant frequency of the tuned "cavity" containing waves which propagate between conductive sides 11 and 3. For the above mentioned dimensions, tuning slugs made of invar (a conductive metal compound which has approximately zero thermal coefficient of expansion) having a diameter of one eighth of an inch and a length of approximately several inches have been found suitable to reduce the resonant frequency of one of the above tuned cavities within the overall range of the 450–470 and 850–870 megahertz communications bands. (It should be noted that the conductive tuning slugs extending into volume 8 produce discontinuities in the volume, and therefore cause undesirable coupling between the orthogonal standing wave patterns. It is therefore desirable that the diameter of the tuning slugs be kept as small as possible and that they be oriented to cause minimum coupling between the orthogonal standing wave patterns.)

Tuning slugs which are responsive to a temperature sensitive control apparatus can be utilized to control the distance of extension of a slidable tuning slug into volume 8 in order to compensate for expansion of cubical apparatus 1 due to temperature, thereby maintaining the tuned resonant frequencies of the three cavities contained within volume 8 independent of temperature.

Still referring to FIG. 5, temperature compensation tuning slug 47 slidably extends into volume 8 through a sleeve 45 which maintains electrical connection between conductive side 11 and temperature compensation tuning slug 47. Line 45 represents a mechanical connection between temperature compensation tuning slug 47 and a temperature responsive control device 50 which causes tuning slug 47 to extend into volume 8 by precisely the amount required to compensate for thermal expansion of the sides of cubical apparatus 1 as temperature increases. It should be noted that various bimetallic temperature sensitive mechanical devices known to those skilled in the art can be readily used to provide the desired movement of temperature compensation tuning slug 47 with variations in temperature.

It has been found that for a diameter of approximately one eighth of an inch, variations of approximately $\pm\frac{1}{4}$ inch in the distance through which tuning slug 47 extends into volume 8 adequately compensate for expansion and contraction of the sides of cubical apparatus 1 over the temperature range $-30°$ C. to $+60°$ C.

It has been found that the above described tuning slugs cause the least amount of undesirable interference between orthogonal resonating standing wave patterns when the tuning slugs are precisely centrally located in the respective sides of cubical apparatus 1. However, it is more important that the E field probes be centrally located on the respective sides from which they extend. In some of the configurations of cubical apparatus 1 disclosed in FIGS. 7–10, it is necessary to offset the tuning slugs from the center of a side of cubical apparatus 1 if coaxial connectors are also required to be mounted on the side on which a tuning slug is needed. For example, FIG. 6 discloses two tuning slugs 41 and 79 offset slightly from the centers of sides of cubical apparatus 1 so that coaxial connector 69 and 17 and the E field probes extending therefrom can be precisely centrally mounted.

As previously mentioned, cubical apparatus 1 shown in FIG. 1 is a three channel combiner, wherein coaxial connectors 15, 17 and 19 are connected to E field input probes. An output E field probe 35 is connected to coaxial connector 21, which is mounted on top side 7 at the common corner of mutually perpendicular sides 3, 5 and 7. E field output probe 35 has a length approximately equal to the length of one side of cubical apparatus 1. It has been experimentally found that if output probe 35 extends along the inside surface of top side 7 along a diagonal thereof and is inclined into volume 8 at a 2°–3° angle with respect to top side 7, as shown in FIGS. 3 and 4, the electrical signals of all three channels are "picked up" by E field output probe 35. The insertion loss has been found to be only approximately 0.5 decibels.

It has been found that if the three or four inch end section 38 of output probe 35 is inclined more steeply (for example, by approximately 15°) with respect to the plane of top side 7, somewhat improved performance results. As seen in FIG. 3, a semicircular bend 37 in output probe 35 is required since E field probe 17A extends into volume 8 from the center of top side 7.

It should be noted that the cubical apparatus 1 of FIG. 1, which, as explained above, is a three channel combiner, functions bidirectionally, so that it can be used as a transmitter combiner and as a duplexer. For example, two of the E field "input" probes (e.g. probes 15 and 17) can be connected to transmitter outputs, and the third E field "input" probe (e.g. probe 19) can be connected to the input of a receiver. E field "output" probe 35 can be connected to an antenna by means of a coaxial cable. If the three "cavities" contained within volume 8 are tuned (by means of the appropriate tuning slugs) to resonant frequencies which are at least 250 to 300 kilohertz apart, there will be negligible interference between the three channels, and the two transmitters and the receiver will be able to operate independently. Thus, it is seen that the terms "input" and "output" as used in conjunction with the E field probes refer to transmitter combiner connections.

Figure 7:
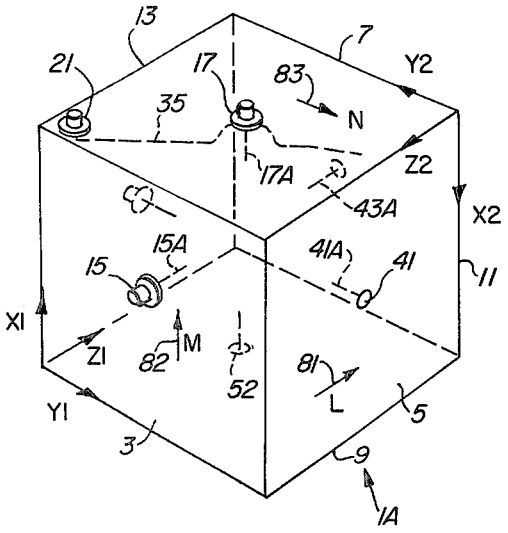
FIG. 7 is a perspective schematic diagram illustrating a three channel combiner in accordance with the present invention.
Figure 8:
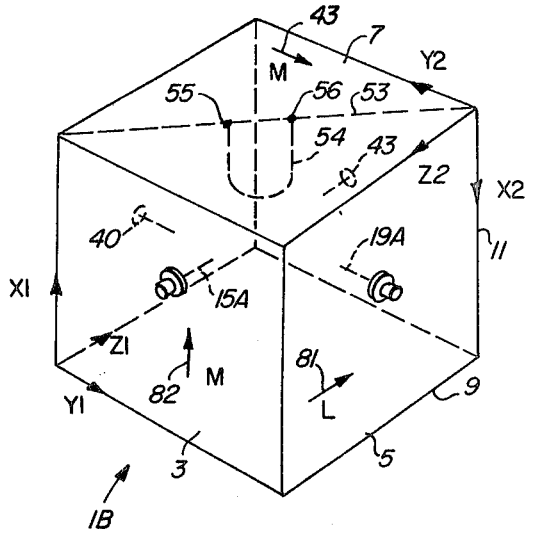
FIG. 8 is a perspective schematic diagram illustrating a double tuned bandpass filter in accordance with the invention.
Figure 9:
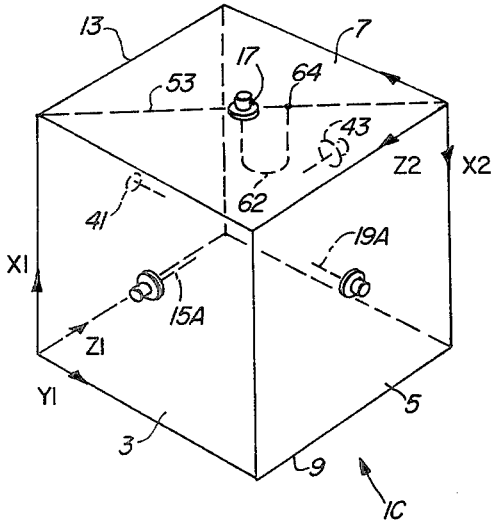
FIG. 9 is a perspective diagram illustrating a two channel combiner in accordance with the invention.

FIGS. 7–10 disclose four especially useful configurations of cubical apparatus 1. FIG. 7 discloses a three channel combiner 1A which is essentially identical to the device shown in FIG. 1, except that it has been drawn slightly differently for convenience of illustration to show the tuning slugs and to show the connection adopted herein for identifying sides in terms of two coordinate systems and to show the convention adopted herein for designating the electric fields produced by the E field probes. FIG. 8 schematically discloses a double tuned bandpass filter. FIG. 9 discloses a two channel combiner, and FIG. 10 discloses cubical apparatus 1D with three pairs of opposed E field input and output probes to provide three independent bandpass filters.

Many other arrangements of E field input probes, E field output probes, and conductive coupling loops can be provided to obtain useful configurations of the cubical apparatus of the present invention. In order to describe some of the additional configurations without providing drawings, the following convention is adopted herein, and is described with reference to FIG. 7.

In accordance with the adopted convention, the cubical apparatus of FIG. 7 can be considered to have two sets of Cartesian coordinate axes, namely, the X1, Y1, Z1 set of axes shown at the lower left hand corner of FIG. 7 and the X2, Y2, Z2 set of axes shown in the upper right hand corner of FIG. 7. Thus, side 3 is referred to as the X1, Y1 side; side 13 is referred to as the X1, Z1 side; and bottom side 9 is referred to as the Y1, Z1 side. Similarly, the other three sides of cubical apparatus 1A are referred to as the X2, Y2 side (side 11); the X2, Z2 side (side 5); and, the Y2, Z2 side (side 7).

Figure 10:
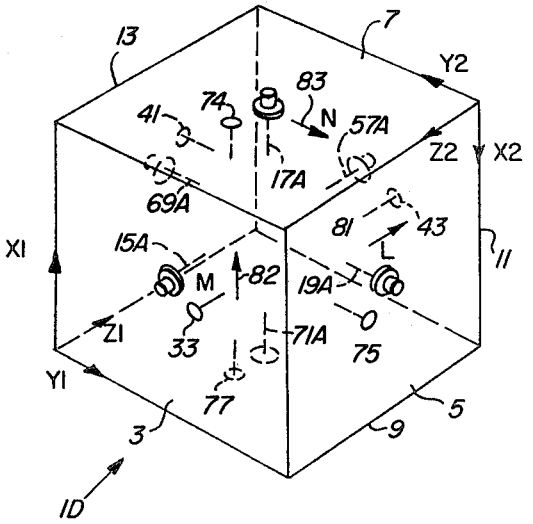
FIG. 10 is a perspective diagram illustrating the cubical device of the invention configured to function as three independently tunable bandpass filters.

Referring now to FIG. 10, cubical apparatus 1D can operate as three separate bandpass filters. E field input probe 15A extends from the center of the X1, Y1 side into volume 8. E field output probe 67A extends into volume 8 from the center of the X2, Y2 side. The E field produced in volume 8 by E field input probe 15A is referred to as the "L" field and is designated by arrow 81. E field probes 15A and 67A in combination with the cubical structure comprise a first bandpass filter, referred to as the "F1" filter, tunable by means of tuning slug 43 located adjacent output probe 67A.

A second filter, referred to as the "F2" filter, includes an E field input probe 69A extending from the center of the X1, Z1 side and an E field output probe 19A extending from the center of the X2, Z2 side. The E field produced in this filter is referred to as the "N" field and is designated by arrow 83. The F2 filter is tunable by means of tuning slug 75 located adjacent the E field output probe 19A.

A third filter, referred to as the "F3" filter, includes E field input probe 71A extending from the center of the Y1, Z1 plane and E field output probe 17A extending from the center of the Y2, Z2 plane and tuning slug 79 adjacent E field output probe 17A. The E field for the F3 filter is referred to as the "M" field and is designated by arrow 82.

As mentioned above, the resonant frequency of the three cavities contained within the cubical structure is determined by the physical dimensions of the cube, but the frequency of each of the three filters (the F1, F2, and F3 filters) can be lowered from the frequency determined by the cube side dimension by insertion of the above described conductive tuning slugs into volume 8.

The F1, F2, and F3 filters in volume 8 can be connected by means of coaxial cables to provide various combiners and composite filters in the same manner as prior coaxial filters or square prism filters.

In FIG. 8, a cubical apparatus 1B configured as a double tuned bandpass filter, is disclosed. E field input probe 15A extends from the X1, Y1 side into volume 8 and E field output probe 19A extends from the X2, Z2 side. An internal conductive grounded coupling loop 54 extends into volume 8 from diagonal 53 of the Y2, Z2 side. Both ends of conductive coupling loop 54 are electrically connected to the conductive surface of the Y2, Z2 side (i.e., top side 7). The internal coupling loop 54 performs the function of coupling the "L" field to the "N" field. The "M" field is tuned "off resonance" (i.e., to a frequency sufficiently separated from the resonant frequencies corresponding to the "L" and "N" frequencies). For the above mentioned dimensions of the cubical structure, suitable performance of the double tuned bandpass filter 1B of FIG. 8 has been obtained when coupling loop 54 extends approximately four inches into volume 8 and has an end radius of curvature of approximately 0.5 inches. The grounded conductive coupling loops have been found to produce a high degree of coupling between the orthogonal standing wave patterns, and thereby eliminate the need for use of external cables for coupling the tuned cavities contained in volume 8 to provide various useful devices such as double tuned filters. Surprisingly, it has been found that the internal coupling achieved for the above described double tuned bandpass filter is as efficient as if a properly matched external coaxial cable were used to series couple the "F1" and "F2" filters to produce a double tuned bandpass filter.

Referring now to FIG. 9, cubical apparatus 1C is configured as a two channel combiner, wherein an E field input probe 15A extends from the X1, Y1 side and another input E field probe 19A extends from the X2, Z2 side. A conductive loop 62 having an end 64 connected to the conductive surface of the Y2, Z2 side has a second end connected to the center conductor of coaxial conductor 17. Conductive loop 62 is aligned with diagonal 53 of the Y2, Z2 side. Tuning slugs 43 and 41 extend from the sides opposite E field probes 15A and 19A, respectively. (It should be noted that the cavity corresponding to the "M" field should be tuned "off resonance", since conductive loop 62 acts as a discontinuity which will cause at least some resonance in the "F3" cavity, and this resonance should therefore be tuned to a frequency whereat it can cause no undesirable effects on the bandpass characteristics of the "F1" and "F2" cavities.)

As previously mentioned, numerous other useful configurations of the above described cubical apparatus can be provided. Following is a list of some additional configurations described in terms of the above mentioned X1, Y1, Z1, and X2, Y2, Z2 coordinate systems, and the "L", "M" and "N" electric fields.

1. Single tuned bandpass filter. E field input probe is on X1, Y1 side, E field output probe is on X2, Y2 plane and E fields "N" and "M" are tuned "off resonance".

2.Triple tuned bandpass filter. E field input probe is on X1, Y1 side, E field output probe is on X2, Z2 side. Conductive coupling loops are inserted into the cubical apparatus from the X1, Z1 and Y2, Z2 sides to couple the three E fields together. Variations of the conductive coupling loops allow the cubical apparatus to respond with bandpass characteristics typically found with conventional triple tuned circuits. (Triple tuned response can also be obtained without using the conductive coupling loop by using external cabling between the three filters "F1", "F2", and "F3".)

3. Single tuned bandpass filter with one double reject notch above resonance. E field input probe is on X2, Z2 side. E field output probe 35 is on corner of Y2, Z2 side, as shown in FIGS. 3 and 4. E fields "L" and "M" each are tuned to desired higher reject frequency. Note that the E field output probe 35 internally couples the "F1" and "F3" filters to the output of bandpass filter "F2", causing them to produce the double reject notch. Similarly, the E field output probe 35 couples internal filters to produce the notches in the embodiments of the invention listed below in (4) through (7).

4. Single tuned bandpass filter with double reject notch below resonance. E field input probe is on X1, Y1 side. E field output probe 35 is on corner of Y2, Z2 plane, as shown in FIGS. 3 and 4. E fields "M" and "N" each are tuned to desired lower reject frequency.

5. Single tuned bandpass filter with two reject notches above resonance. E field input probe is on X2, Z2 side. E field output probe 35 is on corner of Y2, Z2 side, as shown in FIGS. 3 and 4. E fields "L" and "M" are tuned to the two higher reject frequencies, respectively.

6. Single tuned bandpass filter with two reject notches tuned below frequency. E field input probe is on X1, Y1 side. E field output probe 35 is on corner of Y2, Z2 side, as shown in FIGS. 3 and 4. E fields "M" and "N" are tuned to the two lower reject frequencies, respectively.

7. Single tuned bandpass filter with two reject notches, one above resonance, one below. E field input probe is on Y2, Z2 side. E field output probe 35 is on corner of Y2, Z2 plane, as shown in FIGS. 3 and 4. E field "L" is tuned to desired reject frequency above resonance and E field "N" is tuned to desired reject frequency below resonance. (This configuration also can be used to provide an extremely high selectivity bandpass filter by tuning the two reject notches very close to resonance.)

8. Two channel combiner with two inputs, one output, and one reject notch low in frequency. First E field input probe is on X1, Y1 side. Second E field input probe is on Y2, X2 side, E field output probe is on corner of Y2, X2 side. E field "N" is tuned to desired reject frequency. E field "L" is tuned to higher frequency, E field "M" is tuned to a lower frequency.

9. Two channel combiner with two inputs, one output, and a reject notch between two input frequencies. First E field input probe is on X1, Y1 side. Second E field input probe is on X2, Z2 side, E field output probe is on corner of Y2, Z2 side. E field "M" is tuned to desired reject frequency. E field "L" is tuned to higher frequency, E field "N" is tuned to lower frequency.

10. Band reject filter by proper conventional connection of probe 35 to an external transmission line. The three filters can all be tuned to the same reject frequency or each can be tuned to a different frequency having the effect of rejecting three frequencies with a single connection. In this embodiment of the invention, probe 35 is the only probe extending into volume 8.

For the above mentioned 450–470 and 850–870 bands, it has been found that the above described cubical apparatus functions efficiently as a combiner or a filter with very low insertion losses of approximately 0.5 decibels per channel. This is approximately the same insertion loss which would be realized for components comprised of coaxial resonators or square prism filters of the prior art. Further, the "Q" for each filter contained in the above described cubical apparatus is higher than for a coaxial resonator having approximately the same volume.

It has been found that the three possible channels of the previously described combiner have insertion losses of the order of only approximately 0.5 db if the separation between the three transmitter frequencies is at least 250 to 300 kilohertz.

Although the invention has been described with reference to a number of particular embodiments thereof, those skilled in the art readily will be able to provide various modifications thereto without departing from the true spirit and scope of the invention. For example, the described cubical apparatus side dimensions can be selected to provide devices which operate efficiently at much higher and lower frequencies, for example, in the 150 megahertz band and far beyond the 850–880 megahertz band. Further, the sides of the described cubical apparatus can be made of various metals other than copper. For example, aluminum has been found to provide excellent results, even though it is a lower conductivity metal than copper. Conductive inner (or outer) coatings could be provided on non-conductive sheets of material to provide the necessary conductive inner (or outer) surfaces. Further, the volume contained by the cubical apparatus could be filled with various low loss, dielectric materials to provide comparable performance with lower volume. It should be noted that the previously described orientations of output probes were experimentally determined, and various other configurations and orientations could be easily selected by those skilled in the art to provide slightly improved performance in particular frequency ranges. Although good results have been obtained with tuning slugs which extend perpendicularly into the enclosed volume, it has also been found that in certain cases better results occur when the tuning slugs are non-perpendicular with respect to the side from which they extend. Although temperature responsive tuning slugs have been described as a method of maintaining the resonant frequency of the enclosed cavities constant with respect to temperature, it has been found that controlled "bowing" of the sides can be effected to maintain the resonant frequencies in the cubical apparatus constant with respect to varying temperature. In order to provide the desired degree of bowing of the sides with temperature, bimetallic sides could be utilized, which bi-metallic sides would automatically "bow" outward as temperature increases. For higher frequency operation, it might be economical to manufacture the sides from invar, in which case the resonant frequencies would be highly independent of temperature. Although the described operation of the device assumes operation in the TE101 mode, it is possible that other higher order modes might be found useful.

I claim:

1. Apparatus capable of containing a plurality of resonating standing wave patterns in a single volume, said apparatus comprising in combination:

a. six square sides connected together to form a cube, each of said sides having an electrically conductive surface, each of said surfaces being electrically connected to the surface adjacent thereto, said cube containing a volume;

b. first and second electric field probes extending into said volume from said first and second ones of said sides, respectively, said first and second sides being mutually perpendicular; and c. first and second coupling means for coupling first and second high frequency electrical signals to said first and second electric field probes, respectively, whereby said first and second electric field probes produce first and second orthogonal standing wave patterns in said volume.

2. The apparatus of claim 1 further including a third electric field probe extending into said volume from a third one of said sides, said third side being perpendicular to said first and second sides, said apparatus further including third coupling means for coupling a third high frequency electrical signal to said third electric field probe.

3. The apparatus of claim 1 wherein said sides are formed of metal.

4. The apparatus of claim 1 further including third and fourth electric field probes extending into said volume from sides opposite to said first and second sides, respectively, whereby said apparatus can function as two substantially independent bandpass filters.

5. The apparatus of claim 1 further including an output probe extending into said volume from a third side perpendicular to first and second sides, whereby said apparatus functions as a two channel combiner.

6. The apparatus of claim 5 wherein said output probe includes a grounded loop having one end connected to an output connector and another end electrically connected to the conductive surface of said third side.

7. The apparatus of claim 2 further including a third electric field probe extending into said volume from a third side perpendicular to said first and second sides and a fourth electric field probe extending into said volume, whereby said apparatus functions as a three channel combiner.

8. The apparatus of claim 7 wherein said fourth electric field probe includes an electric field probe extending into said volume from the common corner of said first, second, and third sides, said fourth electric field probe extending approximately parallel to said third side along a diagonal of said third side.

9. The apparatus of claim 1 wherein said first and second electric field probes are substantially centrally located with respect to said first and second sides, respectively.

10. The apparatus of claim 1 further including at least one conductive loop extending into said volume from a third one of said sides, said conductive loop causing interference between said first and second standing wave patterns, whereby said apparatus functions as a double tuned bandpass filter.

11. The apparatus of claim 2 further including fourth, fifth, and sixth electric field probes extending into said volume from sides opposite said first, second and third sides, respectively, whereby said apparatus can function as three substantially independent bandpass filters.

12. The apparatus of claim 1 further including first and second tuning means extending into said volume from sides opposite said first and second sides, respectively, each of said tuning means being controllably extendable into said volume to adjust the resonant frequencies of said first and second standing wave patterns, respectively.

13. The apparatus of claim 12 wherein said first and second tuning means includes first and second tuning slugs which include threaded shafts, whereby said first and second tuning slugs can be screwed into said volume to finely adjust said resonant frequencies, respectively.

14. The apparatus of claim 12 further including temperature responsive means coupled to said tuning means to increase and decrease the extension of said tuning means into said volume as temperature of said apparatus decreases and increases, respectively, to maintain said resonant frequencies constant despite variations in temperature of said apparatus and variation in the size of said cube caused by said temperature variations.

15. The apparatus of claim 12 wherein said first and second tuning means are electrically connected to said electrically conductive surfaces.

16. The apparatus of claim 12 wherein said tuning means are adjusted to cause the resonant frequencies of said first and second standing wave patterns to be separated by a predetermined frequency gap.

17. The apparatus of claim 3 wherein said metal is copper.

18. The apparatus of claim 3 wherein said metal is aluminum.

19. The apparatus of claim 1 filled with dielectric material.

20. The apparatus of claim 3 wherein said metal is a metal compound with a thermal expansion coefficient of approximately zero.

21. The apparatus of claim 1 wherein said electrically conductive surfaces are inner surfaces.

22. A multiple tuned band pass filter capable of containing a plurality of resonating standing wave patterns in a single volume, said multiple tuned band pass filter comprising in combination:

a. six square sides connected together to form a cube, each of said sides having an electrically conductive inner surface, each of said inner surfaces being electrically connected to the inner surfaces adjacent thereto, said cube containing a volume;

b. first and second electric field probes extending into said volume from said first and second ones of said sides;

c. first and second coupling means for coupling first and second high frequency electrical signals to and from said first and second electric field probes, respectively; and d. field coupling means extending into said volume for producing sufficient coupling between said plurality of standing wave patterns to effect functioning of said cube in combination with said first and second electric field probes and said first and second coupling means to provide a multiple tuned band pass filter without use of any additional probes or external cables to provide coupling between said plurality of standing wave patterns.

23. A multiple tuned band reject filter capable of containing a plurality of resonating standing wave patterns in a single volume, said multiple tuned band reject filter comprising in combination:

a. six square sides connected together to form a cube, each of said sides having an electrically conductive surface, each of said surfaces being electrically connected to the surfaces adjacent thereto, said cube containing a volume;

b. a probe extending into said volume from a first one of said sides;

c. first coupling means for coupling a first high frequency electrical signal to said first probe; and d. field coupling means extending into said volume for producing sufficient coupling between said plurality of standing wave patterns to effect functioning of said cube in combination with said probe and said first coupling means to provide a multiple tuned band reject filter without the need for use of any additional probes or external connections or cables to provide coupling between said plurality of standing wave patterns.

24. The apparatus of claim 23 wherein said probe is an electric field probe extending from a corner of said first side into said volume.

25. The apparatus of claim 24 further including tuning means controllably extending into said volume from one of said sides for adjusting the frequencies of a resonating standing wave pattern in said volume.

* * * * *